US006601727B2

(12) United States Patent
Sauer et al.

(10) Patent No.: US 6,601,727 B2
(45) Date of Patent: Aug. 5, 2003

(54) CAN LID

(75) Inventors: Rainer Sauer, Neuwied (DE); Werner Erfgen, Melsbach (DE)

(73) Assignee: Rasselstein Hoesch GmbH, Andernach (DE)

( * ) Notice: Subject to any disclaimer, the term of this patent is extended or adjusted under 35 U.S.C. 154(b) by 0 days.

(21) Appl. No.: 09/986,567

(22) Filed: Nov. 9, 2001

(65) Prior Publication Data

US 2002/0053571 A1 May 9, 2002

(30) Foreign Application Priority Data

Nov. 9, 2000 (DE) ..... 100 55 527

(51) Int. Cl.[7] ..... B65D 17/34; B65D 17/40; B65D 08/04

(52) U.S. Cl. ..... 220/359.2; 220/359.1; 220/276; 220/612

(58) Field of Search ..... 220/359.2, 359.3, 220/276, 612, 619, 620, 254.1, 359.1

(56) References Cited

U.S. PATENT DOCUMENTS 3,952,900 A * 4/1976 Rausing ..... 215/232
4,090,004 A 5/1978 Tebbutt et al. ..... 428/64

FOREIGN PATENT DOCUMENTS

| | | |
|---|---|---|
| DE | 2 257 580 | 10/1973 |
| DE | 196 20 448 A1 | 11/1997 |
| DE | 196 29 148 A1 | 1/1998 |
| EP | 0 321 394 A1 | 6/1989 |

* cited by examiner

*Primary Examiner*—Stephen K. Cronin
*Assistant Examiner*—J Smalley
(74) *Attorney, Agent, or Firm*—Lawrence E. Laubscher, Jr.

(57) ABSTRACT

The invention relates to a can lid consisting of a lid ring and a lid membrane having an end face, wherein the lid ring has an annular flange configured as a flattened roll on its inner periphery and surrounding an opening, the end face of said annular flange being directed radially outward and the lid membrane being connected with the annular flange so as to be flat for sealing the opening. A can lid designed according to the present invention should result in fewer injuries during normal handling and should be more resistant to corrosion as a result of the folding under of the peripheral area of the lid membrane.

18 Claims, 2 Drawing Sheets

CAN LID

FIELD OF THE INVENTION

The invention relates to a can lid and to a method for sealing a can with a lid.

BACKGROUND OF THE INVENTION

Can lids having a lid ring and a lid membrane are known from the prior art, for example, from the German Laid-Open Specification 196 20 448 A1. Can lids of this type consist of a lid ring that is made by deep-drawing and punching from a coated sheet-metal blank, e.g. from tin plate, chromium-plated sheet metal or aluminum. An outer flange is provided on the outer edge of the lid ring for the later formation of a double fold and the inner edge of the lid ring has an annular flange which surrounds a lid opening. The annular flange can, for example, be formed by a flattened roll of the inner edge of the lid ring.

To seal a can with a lid of this type, the peripheral area of a lid membrane is fastened so as to be flat, for example, by heat-sealing or gluing, to the upper side of the annular flange pointing away from the inside of the can. The lid membrane thus seals the lid opening which extends over the entire area surrounded by the narrow lid ring. To open the can lid, a pull-open tab is attached to the upper side of the lid membrane. By pulling this tab, the fastening of the lid membrane on the annular flange can be released and the lid membrane pulled off from the lid ring in this way.

To prevent corrosion, the sheet-metal blank from which the lid ring and the lid membrane are made is coated on both sides. In the event that the lid membrane is fastened to the annular flange of the lid ring by means of heat-sealing, the sheet-metal blank is coated with a heat-sealable coating on the one side and provided with an anticorrosive coating on the other side. According to the manufacturing process known from DE 196 20 448, the lid membrane and the lid ring are formed from this sheet-metal blank which is coated on both sides by punching and shaping from the sheet-metal blank. During the punching process, cuts result at the ends on the outer periphery of the lid membrane and on the inner periphery and outer periphery of the lid ring. These cuts are not provided with a coating, so that they are exposed to corrosion.

For these reasons, the can lids made according to the known method tend to corrode at the end faces of the lid ring and the lid membrane, in particular during long storage.

Furthermore, the end face of the lid membrane has sharp edges which could result in injuries when pulling the lid membrane off from the lid ring.

Furthermore, it was also shown in the known can lids that the pull-open tab for removing the lid membrane from the lid ring is not fastened firmly to the lid membrane. Conventionally, the pull-open tab is fastened to the upper side of the lid membrane by heat-sealing or gluing. To ensure sufficient adherence to prevent the pull-open tab from coming undone during the removal process, it is necessary to connect the pull-open tab as extensively as possible with the lid membrane. However, an extensive connection results in a reduction in leverage when the lid membrane is pulled off from the lid ring, so that increased pull-off forces are required.

SUMMARY OF THE INVENTION

Thus, the object of the present invention is to provide an improved can lid of the aforementioned type.

Advantageously, such a can lid can result in reduced risk of injury during normal handling and is resistant to corrosion.

Therefore, in one aspect, the invention provides a can lid comprising a lid ring, for surrounding a lid opening, having on its inner periphery an annular flange configured as a flattened roll. The annular flange terminates at an end face. The annular flange end face is directed radially outward with respect to the lid opening. The can lid further comprises a lid membrane having a peripheral area terminating in an end face, which peripheral area is folded under toward the annular flange. The lid membrane is positioned on the lid ring for sealing the lid opening so as to be flat and so that the end face of the annular flange and the end face of the lid membrane abut one another.

Advantageously, the lid ring and the lid membrane are formed by punching and shaping from a sheet-metal blank coated on both sides.

In one aspect, the sheet-metal blank has a heat-sealable coating on one of the both sides such that an upper side of the annular flange is coated with the heat-sealable coating, the upper side faces away from the lid opening. The lid membrane is fastened to the lid ring by heat sealing to the upper side of the annular flange.

The can lid may further comprise a pull-open tab, for pulling the lid membrane off of the lid ring. The pull-open tab is fastened by laser welding to an upper side of the folded peripheral area of the lid membrane, and the upper side faces away from the lid opening.

An advantage of the can lid according to one embodiment of the invention is that it is even easier to open, than those of the pull-open tab type previously known.

Thus, in one aspect, the invention provides a can lid comprising a lid ring, for surrounding a lid opening, having on its inner periphery an annular flange, and a lid membrane having a peripheral area, which peripheral area is folded under to form a roll. The lid membrane is positioned on the lid ring for sealing the lid opening so as to be flat. A pull-open tab, for pulling the lid membrane off of the lid ring, is fastened along a fastening seam to an upper side of the roll of the lid membrane. The upper side of the roll faces away from the annular flange.

Advantageously, the fastening seam is a soldered seam or a laser weld seam.

In a preferred aspect, the lid membrane has an underside, and the peripheral area is folded under toward the annular flange to form a roll such that the end face of the lid membrane adjoins the underside of the lid membrane.

In another preferred aspect, the pull-open tab is fastened through one its ends to the fastening seam, such that the one end is folded about the roll and anchored in the roll.

In one aspect, the invention provides a can lid comprising a lid ring for attachment to a can and having an inwardly directed flange surrounding a lid opening. The annular flange is in the form of a flattened fold defined by a lower web portion and an upper web portion. The upper web portion is folded outwardly over the lower web portion so as to have a free end face outwardly directed relative to the lid opening. A lid membrane for closing the lid opening and having a peripheral portion terminating in a peripheral end face, is also part of the can lid. The peripheral portion is downwardly rolled over so that the peripheral end face lies in abutting relationship with an abutting surface. The lid membrane is detachably sealed to the upper web portion of the annular flange for subsequent removal by a user.

In another aspect, the invention provides a can lid comprising a lid ring for attachment to a can and having an inwardly directed flange surrounding a lid opening. The annular flange is in the form of a flattened fold defined by a lower web portion and an upper web portion. The upper web portion is folded outwardly over the lower web portion so as to have a free end face outwardly directed relative to the lid opening. At least the upper web portion has a heat-sealable coating thereon. A lid membrane for closing the lid opening and having a peripheral portion terminating in a peripheral end face has a heat-sealable coating on at least a lower face thereof. The peripheral portion is downwardly rolled over so that the peripheral end face lies in abutting relationship with an abutting surface. The lid membrane being detachably heat sealed to the upper web portion for subsequent removal by a user, and the heat-sealable coating extends between the peripheral end face and the abutting surface.

In a further aspect, the invention provides a method for producing a can lid as described herein. The method comprises the steps of folding the peripheral area of the lid membrane under; placing the folded peripheral area of the lid membrane onto the annular flange so that the folded peripheral area surrounds the annular flange; and fastening the lid membrane to an upper side of the annular flange, said upper side facing away from the lid opening.

In another aspect, the method comprises rolling the peripheral portion of the lid membrane downwardly over so that the peripheral end face lies in abutting relationship with an abutting surface, placing the rolled peripheral portion with the lid membrane onto the annular flange so that the rolled peripheral portion surrounds the annular flange, and detachably heat sealing the lid membrane to the upper web portion for subsequent removal by a user. The heat-sealable coating extends between the peripheral end face and the abutting surface.

BRIEF DESCRIPTION OF THE DRAWINGS

The invention shall be explained in greater detail in the following with reference to two examples of embodiments. In this connection, reference is made to the accompanying drawings in which.

DETAILED DESCRIPTION OF PREFERRED EMBODIMENTS OF THE INVENTION

Figure 1:
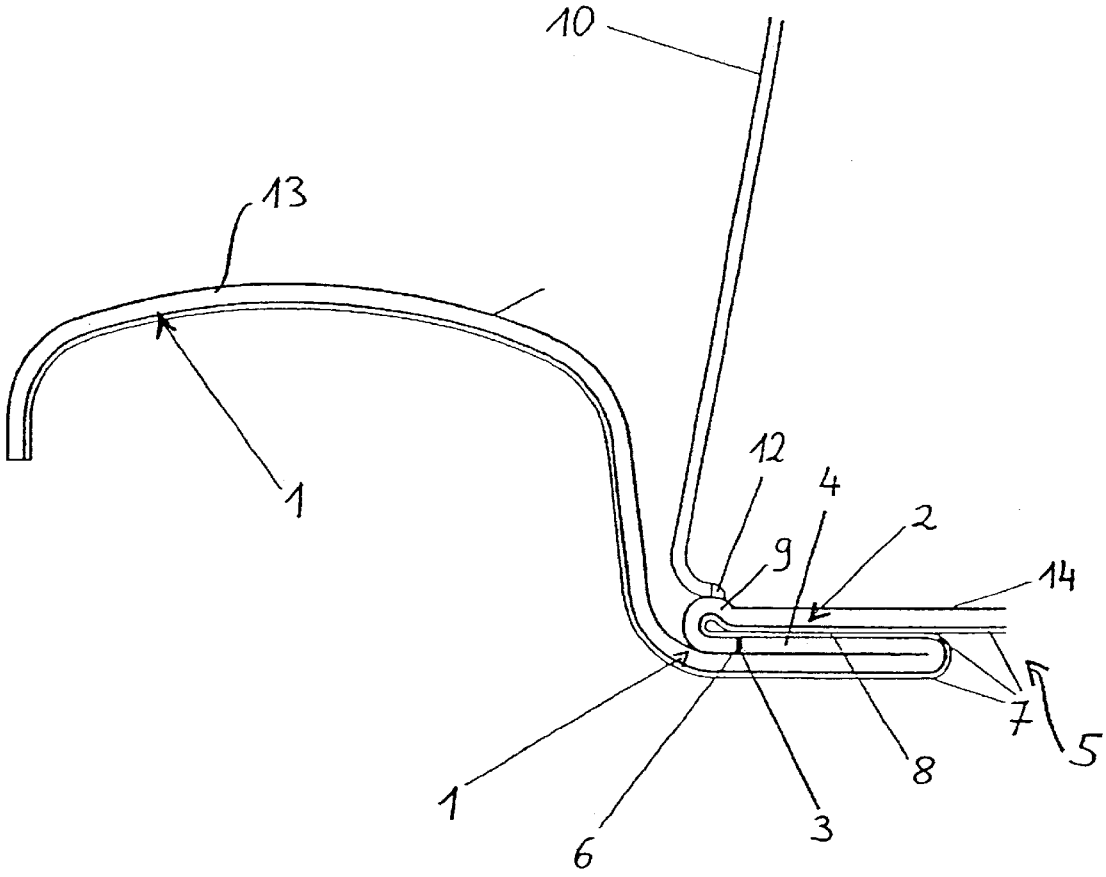
FIG. 1 shows a partial cross section of a first embodiment of a can lid with a lid ring and a lid membrane.

FIG. 1 shows a first embodiment of a finished can lid, wherein this partial section shows the left peripheral area of the can lid. In a top view (not shown here), the can lid can have a round/angular or oval shape. The can lid consists of a lid ring 1 and a lid membrane 2. The left area 13 of the lid ring 1, shown in a cross section of FIG. 1, is used to form an outer flange and to form a double fold with which the lid ring can be fastened to the body of the can. The outer flange or the double fold made therefrom is not shown in FIG. 1. The procedural steps for fastening the lid ring to the body of the can are described, for example, in DE 196 20 448.

On its inner edge, the lid ring 1 has an annular flange 4. It is formed by rolling up the inner peripheral area of the lid ring toward the outer side of the can, i.e. upward in FIG. 1, and then flattened. The ring flange 4 thus formed surrounds a lid opening 5. By rolling and flattening the inner peripheral area of the lid ring, its end face 6 points radially outward.

The lid opening 5 is sealed by a lid membrane 2. For this purpose, the lid membrane 2 is fastened with its outer peripheral area to the upper side 8 of the annular flange 4 pointing to the outer side of the can. The fastening can take place by gluing, welding or heat-sealing. The outer edge 9 of the lid membrane 2 is folded over, so that the end face 3 of the lid membrane points radially inward. The lid membrane 2 is fastened to the annular flange 4 of the lid ring 2 in such a way that the peripheral area 9 that is folded over radially surrounds the annular flange 4. Furthermore, the folded peripheral area 9 is pressed in downward, so that the end face 3 of the lid membrane abuts the end face 6 of the annular flange 4.

To seal a can with a lid of this type, the lid ring is first fastened in a known manner to the body of the can by formation of a double fold. The can is then filled with the contents and the lid opening sealed with the lid membrane.

Alternatively, the can can also be sealed by first fastening the lid membrane to the lid ring and then attaching the lid ring to the body of the can in a known manner. The method for producing a can lid according to a method of the invention comprises both alternatives with respect to the sequence of steps for sealing the can.

Preferably, lid ring 1 and lid membrane 2 are formed by punching and shaping from a sheet-metal blank coated on both sides with an organic material. To this end, a sheet-metal blank is first deep-drawn, as described in DE 196 20 448. During deep-drawing, a flat dish is formed surrounded by an outer flange, said dish having a bottom part and a wall part essentially at a right angle thereto. The outer flange is used to form a double fold for the subsequent fastening of the lid ring to the body of the can. Essentially, the entire bottom part is then punched out in the immediate vicinity of its transition to the wall part to form the lid ring, the inner cut area of said lid ring—resulting during punching—surrounding the lid opening 5. The wall part is then bent partially outward to form a rolling. This roll is then flattened to form the annular flange 4. The punched out bottom part is then folded over in the peripheral area 9, so that the end 3 faces radially inward. The bottom part thus shaped forms the lid membrane 2 for sealing the lid opening 5.

To seal the lid opening, the lid membrane 2 is placed on the annular flange 4 with the folded peripheral area 9 in such a way that it points to the annular flange 4, so that the folded peripheral area 9 surrounds the annular flange 4. The lid membrane 2 is then fastened to the upper side 8 of the annular flange 4. Prior to or during the fastening process, the folded peripheral area 9 of the lid membrane 2 is pressed in such a way that the face 3 of the lid membrane abuts the face 6 of the annular flange.

Advantageously, the lid membrane 2 is fastened to the upper side 8 of the annular flange 4 over the entire upper surface of the annular flange 4. It is preferably fastened by heat-sealing. For this purpose, the sheet-metal blank—from which the lid ring 1 and lid membrane 2 are made—is provided with a heat-sealable coating on one side. The heat-sealable coating can, for example, be a film of polypropylene, polyethylene terephthalate, a sealable organic lacquer, or the like. The orientation is thereby selected in such a way that the heat-sealable coating 7 comes to lie on the upper side 8 of the annular flange 4. Accordingly, the lid membrane 2 is oriented in such a way that the heat-sealable coating points to the inside of the can, i.e. downward in FIG. 1.

During heat-sealing, the heat-sealable coating 7 becomes viscous due to the effect of the heat and pressure and can flow into the narrow space between the front ends 3, 6 of the annular flange and the lid membrane. During the heat-sealing process, by light pressure from the top by means of an appropriate tool, the lid membrane 2 is pressed onto the upper side 8 of the annular flange 4, on the one hand, and, on the other hand, the folded peripheral area 9 of the lid membrane 2 is also pressed downward and radially inward. As a result of this pressing, the end face 3 of the lid membrane 2 is pressed against the face 6 of the annular flange 4. In this way, the faces 3, 6, at first uncoated, of the lid membrane and the annular flange are pressed against one another so as to abut and provided, at least on the upper side, with a heat-sealable coating. As a result, the ends 3, 6 are protected against corrosion because neither moisture nor atmospheric oxygen can reach the initially unsealed ends.

To open the lid of the can, a pull-open tab 10 is preferably fastened to the upper side 14 pointing to the can exterior at a point of the folded peripheral area 9 of the lid membrane 2. Preferably, the pull-open tab 10 is fastened by laser welding. The pull-open tab 10 can, however, also be fastened to the lid membrane 2 by soldering or gluing. By manually pulling this pull-open tab 10, the folded peripheral area 9 of the lid membrane 2 is first removed from the lid ring 1 and the area of the lid membrane 2 fastened to the annular flange 4 is then pulled off.

The lid membrane 2 thus removed does not have any sharp edges along its periphery since the peripheral area 9 is folded over. As a result, the removed lid membrane 2 cannot result in cuts.

Furthermore, the can lid thus formed has the advantage that, due to the mutual abutment of the end faces 3, 6 of the lid membrane and the annular flange, it protects these ends against contact with moisture and oxygen and thus against corrosion.

A further embodiment of the can lid according to FIG. 2 will be described in the following. To the extent that features of the subject matter of FIG. 2 are included in the can lid of FIG. 2, identical reference numbers will be used and reference made to the preceding description of the embodiment of FIG. 1.

Figure 2:
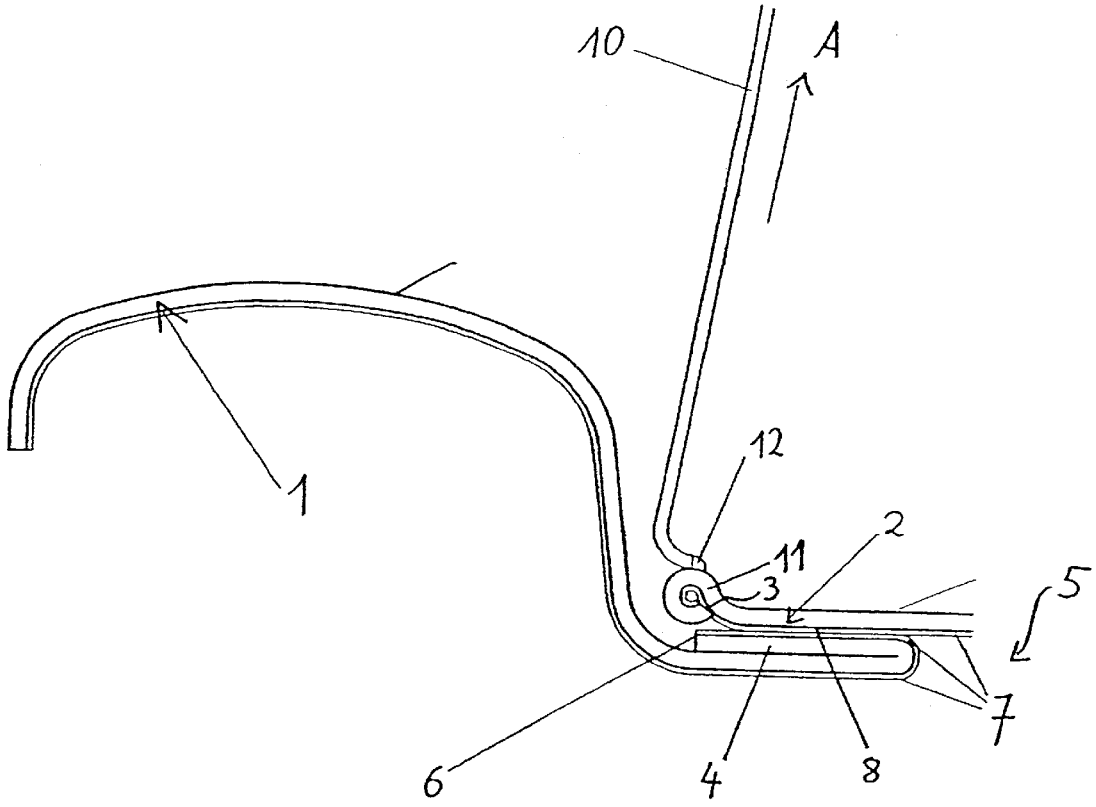
FIG. 2 shows a partial cross section of a second embodiment of a can lid with a lid ring and a lid membrane.

The embodiment of a can lid according to FIG. 2 has a lid ring 1 and a lid membrane 2. The lid membrane 2 is folded over on its outer edge to form a roll 11. As shown in FIG. 2, this roll 11 is essentially circular in cross section. The peripheral area of the lid membrane is thereby rolled over to such an extent that the end 3 adjoins the underside 8 of the lid membrane 2. The underside 8 of the lid membrane 2 is thereby either provided with a heat-sealable coating 7 or enamelled. As a result of the front end 3 adjoining the coating 7 or the enamel, the front end 3 is protected against moisture and oxygen and thus against corrosion.

The underside 8 of the lid membrane 2 facing the inside of the can is fastened in its peripheral area to the upper side 8 of the annular flange. As in the embodiment of FIG. 1, the fastening may again be accomplished by thermal sealing of the heat-sealable coatings on the upper side 8 of the annular flange 4 and the underside of the lid membrane 2. Alternatively, gluing or welding may be used as a means of fastening.

A pull-open tab 10 is fastened, in the area of the roll 11, to its upper side, i.e. to the side facing away from the annular flange 4. The pull-open tab 10 is preferably fastened by means of laser welding at the weld seam 12. The welding point 12 is thereby as close as possible to the edge of the flanged roll 11. As a result, it is attained that the leverage is as great as possible when pulling the pull-open tab 10 in longitudinal direction A of the tab. Due to the great leverage, only slight forces are required for pulling the lid membrane 2 off from the annular flange 4.

Compared with the known methods for fastening the pull-open tab 10 to the lid membrane 2, the laser welding is distinguished thereby that a sufficiently stable fastening of the tab 10 to the lid membrane 2 is also assured with very small fastening areas at the weld seam 12. As a result, the maximum possible leverage can be used when pulling the tab 10 since the relatively small fastening surface can be very close to the outer edge of the lid membrane 2. Thus, the tractive power is transmitted by the pull-open tab 10 to the lid membrane 2 essentially in the peripheral area of the roll 11.

When fastening the pull-open tab 10 by means of laser welding, the roll 11 offers sufficient rigidity. Due to the limited thickness of the material, it would not be possible to weld the pull-open tab 10 directly to the periphery of the lid membrane 2 without having formed the roll 11.

Therefore, the roll 11 is shown to be advantageous, on the one hand, due to the slight danger of injury and, on the other hand, due to the improved fastening of the pull-open tab 10 to the lid membrane 2.

All references mentioned herein are incorporated by reference.

We claim:

1. A can lid comprising:

a lid ring for attachment to a can and having an inwardly directed annular flange surrounding a lid opening, said annular flange being in the form of a flattened fold defined by a lower web portion and an upper web portion, said upper web portion being folded outwardly over the lower web portion so as to have a free end face outwardly directed relative to said lid opening; and a lid membrane for closing said lid opening and having a peripheral portion terminating in a peripheral end face, said peripheral portion being downwardly rolled over so that said peripheral end face lies in abutting relationship with an abutting surface, said abutting surface being either the end face of the annular flange or an underside of said lid membrane, and said lid membrane being detachably sealed to said upper web portion of said annular flange for subsequent removal by a user.

2. A can lid comprising:

a lid ring for attachment to a can and having an inwardly directed annular flange surrounding a lid opening, said annular flange being in the form of a flattened fold defined by a lower web portion and an upper web portion, said upper web portion being folded outwardly over the lower web portion so as to have a free end face outwardly directed relative to said lid opening, and at least said upper web portion having a heat-sealable coating thereon; and a lid membrane for closing said lid opening and having a peripheral portion terminating in a peripheral end face, said lid membrane having a heat-sealable coating on at least a lower face thereof and said peripheral portion being downwardly rolled over so that said peripheral end face lies in abutting relationship with an abutting surface, said abutting surface being either the end face of the annular flange or an underside of said lid membrane, said lid membrane being detachably heat sealed to said upper web portion for subsequent removal by a user, and said heat-sealable coating extending between said peripheral end face and said abutting surface.

3. A can lid comprising:

a lid ring, for surrounding a lid opening, having on its inner periphery an annular flange configured as a flattened roll, said annular flange terminating at an end face, said annular flange end face being directed radially outward with respect to the lid opening; and a lid membrane having a peripheral area terminating in an end face, which peripheral area is folded under toward the annular flange, said lid membrane positioned on said lid ring for sealing the lid opening so as to be flat and so that the end face of the annular flange and the end face of the lid membrane abut one another.

4. The can lid according to claim 3, wherein the lid ring and the lid membrane are formed by punching and shaping from a sheet-metal blank.

5. The can lid according to claim 4, wherein the sheet-metal blank has a heat-sealable coating on one of the both sides such that said coating is present on an upper side of the annular flange formed from said sheet-metal blank, said upper side facing away from the lid opening, and the lid membrane is fastened to the lid ring by heat sealing to the upper side of the annular flange.

6. The can lid according to claim 3, further comprising:

a pull-open tab, for pulling the lid membrane off of the lid ring, said pull-open tab fastened by laser welding to an upper side of the folded peripheral area of the lid membrane, said upper side facing away from the lid opening.

7. A can lid comprising:

a lid ring, for surrounding a lid opening, having on its inner periphery an annular flange configured as a flattened roll, said annular flange terminating at an end face, said annular flange end face being directed radially outward with respect to the lid opening;

a lid membrane having a peripheral area terminating in an end face, which peripheral area is folded under toward the annular flange, said lid membrane positioned on said lid ring for sealing the lid opening so as to be flat and so that the end face of the annular flange and the end face of the lid membrane abut one another; and a pull-open tab, for pulling the lid membrane off of the lid ring, fastened by laser welding to an upper side of the folded peripheral area of the lid membrane, said upper side facing away from the inside of the can;

wherein the lid ring and the lid membrane are formed by punching and shaping from a sheet-metal blank; and wherein the sheet-metal blank has a heat-sealable coating on one of the both sides such that said coating is present on an upper side of the annular flange formed from said sheet-metal blank, said upper side of the annular flange facing away from the inside of the can, and the lid membrane is fastened to the lid ring by heat sealing to the upper side of the annular flange.

8. A can lid comprising:

a lid ring, for surrounding a lid opening, having on its inner periphery an annular flange;

a lid membrane having a peripheral area, which peripheral area is folded under to form a roll, said lid membrane positioned on said lid ring for sealing the lid opening so as to be flat; and a pull-open tab, for pulling the lid membrane off of the lid ring, fastened along a fastening seam to the roll of the lid membrane.

9. A can lid according to claim 8, wherein the fastening seam is a soldered seam or a laser weld seam.

10. The can lid according to claim 8, wherein the lid membrane has an underside, and wherein the peripheral area is folded under toward the annular flange to form the roll such that the end face of the lid membrane adjoins the underside of the lid membrane.

11. The can lid according to claim 8, wherein the pull-open tab is fastened through one of its ends to the fastening seam, such that said one of its ends is folded about the roll and anchored in the roll.

12. A can lid comprising:

a lid ring, for surrounding a lid opening, having on its inner periphery an annular flange configured as a flattened roll, said annular flange terminating at an end face, said annular flange end face being directed radially outward with respect to the lid opening;

a lid membrane having a peripheral area, which peripheral area is folded under toward the annular flange to form a roll such that an end face of the lid membrane adjoins an underside of the lid membrane, said lid membrane positioned on said lid ring for sealing the lid opening so as to be flat; and a pull-open tab, for pulling the lid membrane off of the lid ring, fastened through one of its ends to the roll of the lid membrane along a fastening seam such that said one of its ends is folded about the roll and anchored in the roll.

13. A method for producing a can lid, the can lid comprising a lid ring for surrounding a lid opening, the lid ring having on its inner periphery an annular flange configured as a flattened roll, said annular flange terminating in an end face, said annular flange end face being directed radially outward with respect to the lid opening; and a lid membrane having a peripheral area terminating in an end face, said lid membrane being positionable on said lid ring for sealing the lid opening so as to be flat; said method comprising the steps of:

folding the peripheral area of the lid membrane under;

placing the folded peripheral area of the lid membrane onto the annular flange so that the folded peripheral area surrounds the annular flange; and fastening the lid membrane to an upper side of the annular flange, said upper side facing away from the lid opening;

wherein during the folding, the peripheral area of the lid membrane is folded under either (i) in such a manner that the end face of the lid membrane points radially inward with respect to the lid opening; and wherein, prior to or during fastening, the end face of the annular flange and the end face of the lid membrane come to abut one another; or (ii) to form a roll such that the end face of the lid membrane adjoins an underside of the lid membrane.

14. The method according to claim 13, wherein the lid ring and the lid membrane are formed by punching and shaping from a sheet-metal blank.

15. The method according to claim 14, wherein one of the both sides of the sheet-metal blank is coated with a heat-sealable coating and the lid membrane is fastened by heat-sealing.

16. The method according to claim 15, wherein the heat-sealable coating is liquefied during the heat-sealing and pressed between the end face of the annular flange and the end face of the lid membrane.

17. A method for producing a can lid, the can lid comprising a lid ring for attachment to a can and having an inwardly directed annular flange surrounding a lid opening, said annular flange being in the form of a flattened fold defined by a lower web portion and an upper web portion, said upper web portion being folded outwardly over the lower web portion so as to have a free end face outwardly directed relative to said lid opening, and at least said upper web portion having a heat-sealable coating thereon; and a lid membrane for closing said lid opening and having a peripheral portion terminating in a peripheral end face, said lid membrane having a heat-sealable coating on at least a lower face thereof, the method comprising:

rolling the peripheral portion of the lid membrane downwardly over so that the peripheral end face lies in abutting relationship with an abutting surface, said abutting surface being either the end face of the annular flange or an underside of said lid membrane;

placing the rolled peripheral portion with the lid membrane onto the annular flange so that the rolled peripheral portion surrounds the annular flange; and detachably heat sealing said lid membrane to said upper web portion for subsequent removal by a user, said heat-sealable coating extending between said peripheral end face and said abutting surface.

18. The can lid according to claim 8, wherein the pull-open tab is fastened along a fastening seam to an upper side of the roll of the lid membrane, said upper side of the roll facing away from the annular flange.

* * * * *